US009365033B1

(12) United States Patent
Klein Koerkamp et al.

(10) Patent No.: US 9,365,033 B1
(45) Date of Patent: Jun. 14, 2016

(54) METHOD FOR COMPENSATING FAILING NOZZLES

(71) Applicant: OCE-TECHNOLOGIES B.V., Venlo (NL)

(72) Inventors: Koen J. Klein Koerkamp, Venlo (NL); Franciscus J. M. Van Galen, Venlo (NL); Albert G. M. Van Welie, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/009,446

(22) Filed: Jan. 28, 2016

(30) Foreign Application Priority Data

Jan. 29, 2015 (EP) ..... 15152969

(51) Int. Cl.
*B41J 2/21* (2006.01)
*B41J 2/045* (2006.01)

(52) U.S. Cl.
CPC ..... *B41J 2/0451* (2013.01); *B41J 2/04586* (2013.01); *B41J 2/2139* (2013.01)

(58) Field of Classification Search
CPC ..... B41J 29/393; B41J 2/2139; B41J 2/0451; B41J 2/16579; B41J 2/2142; B41J 2/165
See application file for complete search history.

(56) References Cited

U.S. PATENT DOCUMENTS 7,591,525 B2 * 9/2009 Arazaki ..... B41J 29/393 347/15
7,673,958 B2 3/2010 Heiles et al.
2004/0223014 A1 11/2004 Barr et al.
2013/0222455 A1 8/2013 Wu et al.
2014/0300656 A1 10/2014 Ueshima

FOREIGN PATENT DOCUMENTS

EP 1 384 592 A1 1/2004

* cited by examiner

*Primary Examiner* — Thinh Nguyen
(74) *Attorney, Agent, or Firm* — Birch, Stewart, Kolasch & Birch, LLP

(57) ABSTRACT

A method is provided for controlling the ejection of ink drops from an inkjet printhead. The printhead comprises an array of ink chambers with nozzles arranged for applying a row of ink dots on a receiving medium using a control signal. The method comprises the steps of labeling a nozzle as a functioning nozzle if the nozzle, upon activation by a control signal, ejects an ink drop within predefined specifications, otherwise labeling the nozzle as a failing nozzle, and distributing a control signal associated with a failing nozzle to a neighboring nozzle to maintain a local optical density, wherein said control signal associated with a failing nozzle is not distributed to a neighboring nozzle, if a neighboring nozzle of said failing nozzle is also labeled as a failing nozzle.

7 Claims, 3 Drawing Sheets

METHOD FOR COMPENSATING FAILING NOZZLES

BACKGROUND OF THE INVENTION

1. Field of the Invention

The present invention relates to a method for controlling the ejection of ink drops from an inkjet printhead comprising an array of ink chambers with nozzles arranged for applying a row of ink dots on a receiving medium using a control signal. The invention further relates to an inkjet print system for printing images on a receiving medium by controlling a printhead to eject ink.

2. Description of the Related Art

Inkjet print systems are widely known and applied to print images on a variety of receiving materials, such as paper, cardboard, vinyl, or any other substantially flat material by an inkjet process. In these systems, all kinds of ink or other marking material are used, either water, solvent, UV-curable or phase-change based, which are all referred to as inks in this description. Drops of ink are made by first increasing a pressure in an ink chamber, either by partly vaporizing the ink in the chamber using a heating element or by generating an acoustic wave in the ink chamber by a piezo-electric actuator or otherwise, thereby pushing ink through a nozzle, which is in connection with the ink chamber, and then decreasing the pressure to stop a flow of ink through the nozzle. In the case of acoustic actuation, a reverse operation by first decreasing a pressure for filling an ink chamber with ink and then increasing the ink chamber pressure is also possible and often used. Upon hitting the receiving material, an ink drop causes an ink dot for locally marking the material by changing an optical density. The size of the dot depends on several factors, among which the size, or volume, and velocity of the ink drop and the mutual interaction between the ink and the receiving material. An array of ink chambers with nozzles is provided in a printhead to be able to print a row of ink dots and a movement of the printhead relative to the receiving material in a direction perpendicular to the row of ink dots enables the application of ink drops to an area of the receiving material. These inkjet systems are known as drop on demand systems.

A control signal is provided to the inkjet printhead to determine a timing of a drop ejection and the drop properties, such as the drop size and drop velocity. Some printheads only allow one drop size, but more and more printheads may be controlled to apply several drop sizes by each of the nozzles in the array. The determination of the control signals for generating a printed image from a digital image, wherein a local color of pixels is specified, involves a number of elaborate calculations that take into account among others the arrangement of the nozzles in the printhead, the movement of the printhead relative to the receiving medium and the velocity and size of the ink drops. Some of these characteristics may need calibration for achieving optimal performance.

Inkjet printheads comprise more and more nozzles, on the one hand to increase a printed image resolution in terms of dots per inch, on the other hand to increase a width of a printhead for printing a larger swath while crossing a receiving medium. Occasionally, a nozzle is unable to produce an ink drop as required according to specifications for a regular ink drop. This may be caused by an incorporation of a gas bubble in the ink chamber or another obstruction that hinders a regular formation of an ink drop. In some cases, a blockade is only temporary and a period of not activating the nozzle will resolve the impairment. In other cases, a non-functioning nozzle is the result of production tolerances or aging of the printhead. In any case, an individual nozzle failure does not necessarily mean the end of life of a printhead. According to known prior art, a control signal may be distributed to neighboring nozzles in an attempt to obfuscate a missing dot. The control signal may partly or completely be passed to a neighboring position within the array of nozzles in order to preserve an intended change of optical density using one and the same colorant, albeit on a slightly different position than specified by the digital image. In another version, a control signal is passed to a nozzle associated with the same position on the receiving material as the anomalous nozzle, but ejecting an ink drop of a different colorant. A further method for compensating a non-functioning nozzle involves the application of a second nozzle that passes the same position in a print strategy that applies several passes of the printhead over an area of the receiving material. The second nozzle thus prints additional ink in order to compensate the missing ink from the blocked nozzle at the cost of a slower print speed. It is noted that the functioning of a nozzle depends on a precision of the specifications for a regular ink drop. In some print systems, it is advantageous to use narrow specifications, since it allows a nozzle to recover during a time it is not activated by a control signal.

Whether a nozzle produces an ink drop according to specifications may be determined either by measuring drop properties, such as velocity and volume, or by measuring a position and size of an ink dot that is associated with an ink drop and a nozzle that has produced the drop. Commonly, optical methods are employed for this purpose, but also known is to use a feedback signal from a sensor element associated with a nozzle. Either way, a nozzle may be labeled as functioning and will be activated in accordance with an image to be printed. A non-functional nozzle is not activated, since the resulting dot will not be according to the specifications and the non-activation may restore its functioning. The defect in the printed image corresponding to a non-functional nozzle may have a limited impact on the print quality, if the size of the ink dots is sufficiently large, thereby already obfuscating missing dots, or if a compensation method is applied as sketched above.

However, there remains a problem in print quality in ink jet print systems from occasional lines of missing ink dots, related to a single nozzle. An object of the present invention is to further improve print quality regarding these lines.

SUMMARY OF THE INVENTION

According to the present invention, a method for controlling the ejection of ink drops from an inkjet printhead comprising an array of ink chambers with nozzles arranged for applying a row of ink dots on a receiving medium using a control signal, comprises the steps of: a) labeling a nozzle as a functioning nozzle if the nozzle, upon activation by a control signal, ejects an ink drop within predefined specifications, otherwise labeling the nozzle as a failing nozzle, b) distributing a control signal associated with a failing nozzle to a neighboring nozzle to maintain a local optical density, wherein said control signal associated with a failing nozzle is not distributed to a neighboring nozzle, if a neighboring nozzle of said failing nozzle is also labeled as a failing nozzle.

It has been observed by the inventors, that a single failing nozzle in-between two functioning nozzles does not result in a line of missing dots, because of the application of control signal distribution that compensates a missing dot. The remaining visible lines of missing ink dots are related to two failing nozzles beside each other. If, for compensation, a control signal is distributed independent of the functioning of a neighboring nozzle, the compensation may partly be assigned to a non-functional nozzle and thus not be applied. Furthermore, two non-functioning nozzle beside each other increase the width of the line of missing ink dots, thereby enhancing its visibility. The remedy has been found in the conditional distribution of a control signal for a non-functioning nozzle in dependence on the status of a neighboring nozzle. Most often, a non-functioning nozzle is still able to apply an ink dot, although not according to predetermined specifications, such as within a specific distance of an intended position. However, it has been found that such an ink dot from a non-functioning nozzle is still preferable to no dot at all in the case of two neighboring failing nozzles. Therefore, the method according to the present invention reduces the visibility of a line of missing ink dots.

In a further embodiment, a failing nozzle is labeled as either a blocked nozzle, if no ink drop is ejected upon activation by a control signal, or a deviating nozzle, if an ink drop outside predefined specifications is ejected, and a control signal associated with a deviating nozzle is not distributed to a neighboring nozzle, if a neighboring nozzle of said deviating nozzle is labeled as a failing nozzle, but a control signal associated with a blocked nozzle is distributed to a neighboring nozzle, if a neighboring nozzle of said blocked nozzle is labeled as a failing nozzle. Since a blocked nozzle is unable to apply any ink dot, anything is better than directing a control signal to this nozzle. Most often, a failing nozzle is a deviating nozzle and for this kind of failing nozzle it is preferred not to distribute the corresponding control signal.

In a further embodiment, the step of labeling a nozzle is made during an application of the inkjet printhead in a print process. During a print process, a nozzle may become failing, e.g. if it is actuated in an unstable condition of the ink chamber. In its failing state, a nozzle produces upon activation an ink drop that is outside a predetermined range of size and velocity, which results in an ink dot outside a distance range from an intended position. This may be observed by receiving a feedback signal from a sensor element associated with a nozzle in the printhead, or by optically monitoring a pattern printed by the printhead. Similarly, it may be observed, that a nozzle has recovered from a failing state, as it is well known, that leaving an ink chamber unactivated for a period of time may reestablish its functioning. Thus, the state of an ink chamber and its corresponding nozzle is a dynamic state, which is monitored during a print process, such that a print process control may adapt an activation of the nozzle to a present state.

Further details of the invention are given in the dependent claims. The present invention may also be embodied in an inkjet print system comprising a control unit that is configured to execute the steps of the above mentioned methods and combinations of the various steps.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF EMBODIMENTS

Figure 1:
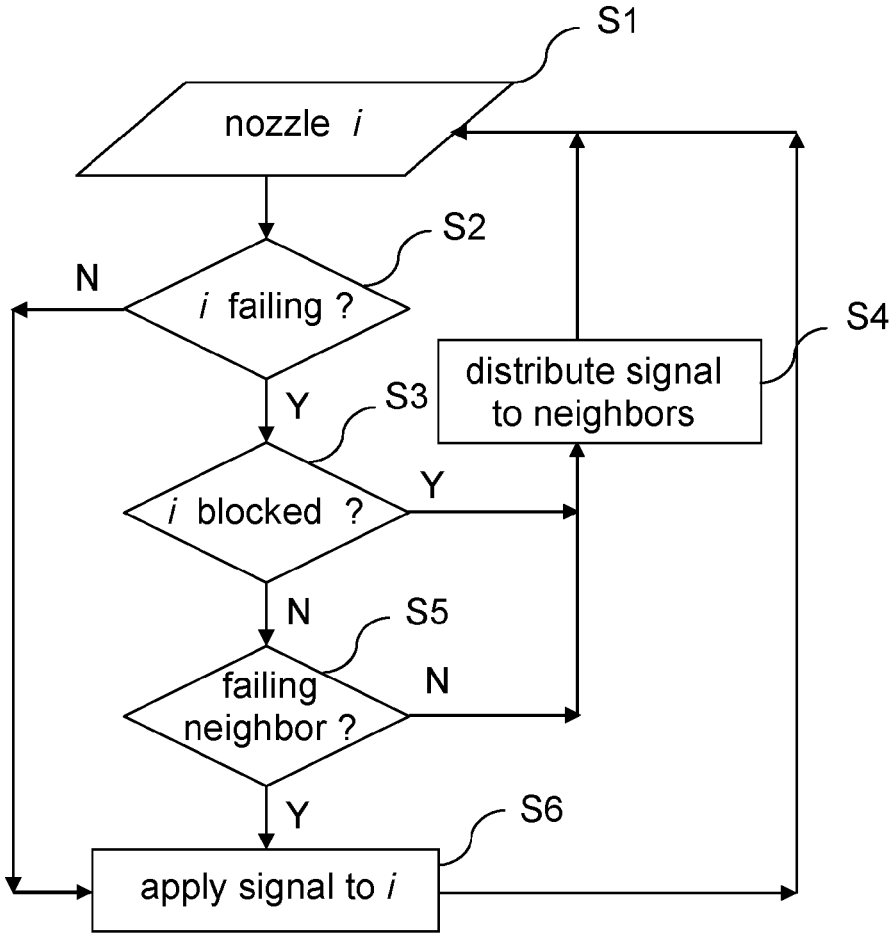
FIG. 1 shows the steps of a method to deal with failing nozzles.

The present invention will now be described with reference to the accompanying drawings, wherein the same or similar elements are identified with the same reference numeral.

FIG. 1 shows an embodiment of a method for dealing with failing nozzles, wherein the invention is used. The method is used to decide how a control signal for a printhead is to be applied by the printhead. The printhead comprises a row of elements for ejecting ink drops, the elements comprising an ink chamber with corresponding nozzles. An element producing an ink drop and its corresponding ink dot within predefined specifications is called a functioning nozzle. In the present embodiment, this means that the dot diameter is within 15% of a mean observed value and its position is not further than 50% of the dot diameter from its intended position. These specifications relate to ink drops having a predetermined velocity and volume. A timing calibration makes an ink drop ejected to reach an intended position. Therefore, a deviating drop velocity or drop volume will make the ink drop land on a deviating position or result in a deviating dot diameter. If an element is not functioning, or failing, it may either produce an ink dot outside the predetermined specifications or no ink drop at all. In the first case it is labeled as a deviating nozzle, whereas in the second case it is labeled as a blocked nozzle. The labeling occurs by optically monitoring a printed pattern and comparing the produced ink dots with an intended pattern. Alternatively, a feedback signal from a printhead element may be used to label the nozzles.

A control signal for a row of nozzles is processed according to the steps in the flow chart of FIG. 1, after all ink chambers of a printhead with corresponding nozzles have been labeled as functioning, deviating, or blocked. In step S1, a particular nozzle i from the row of nozzles is selected. The procedure is executed for each nozzle in the row separately. In step S2, the status of nozzle i is verified. If it is functioning, which is the same as not failing, branch N will be followed and a control signal associated with nozzle i will be applied to this nozzle (step S6). If it is not functioning, branch Y will be taken from step S2 to step S3, where it is verified whether nozzle i is blocked. If it is (Y), a control signal associated with the nozzle is distributed to neighboring nozzles, in this embodiment over nozzle i−1 and nozzle i+1, according to a known distribution scheme. If it is not blocked (N), thus the nozzle i is producing a deviating dot, the status of a neighbor nozzle is verified in step S5. If none of the neighboring nozzles is failing (N), i.e. neither blocked nor deviating, the control signal is distributed to neighboring nozzles (step S4), and otherwise (Y), the control signal attributed to nozzle i to applied by nozzle i (step S6). This procedure is repeated until all nozzles and their corresponding control signals have been processed.

Figure 2:
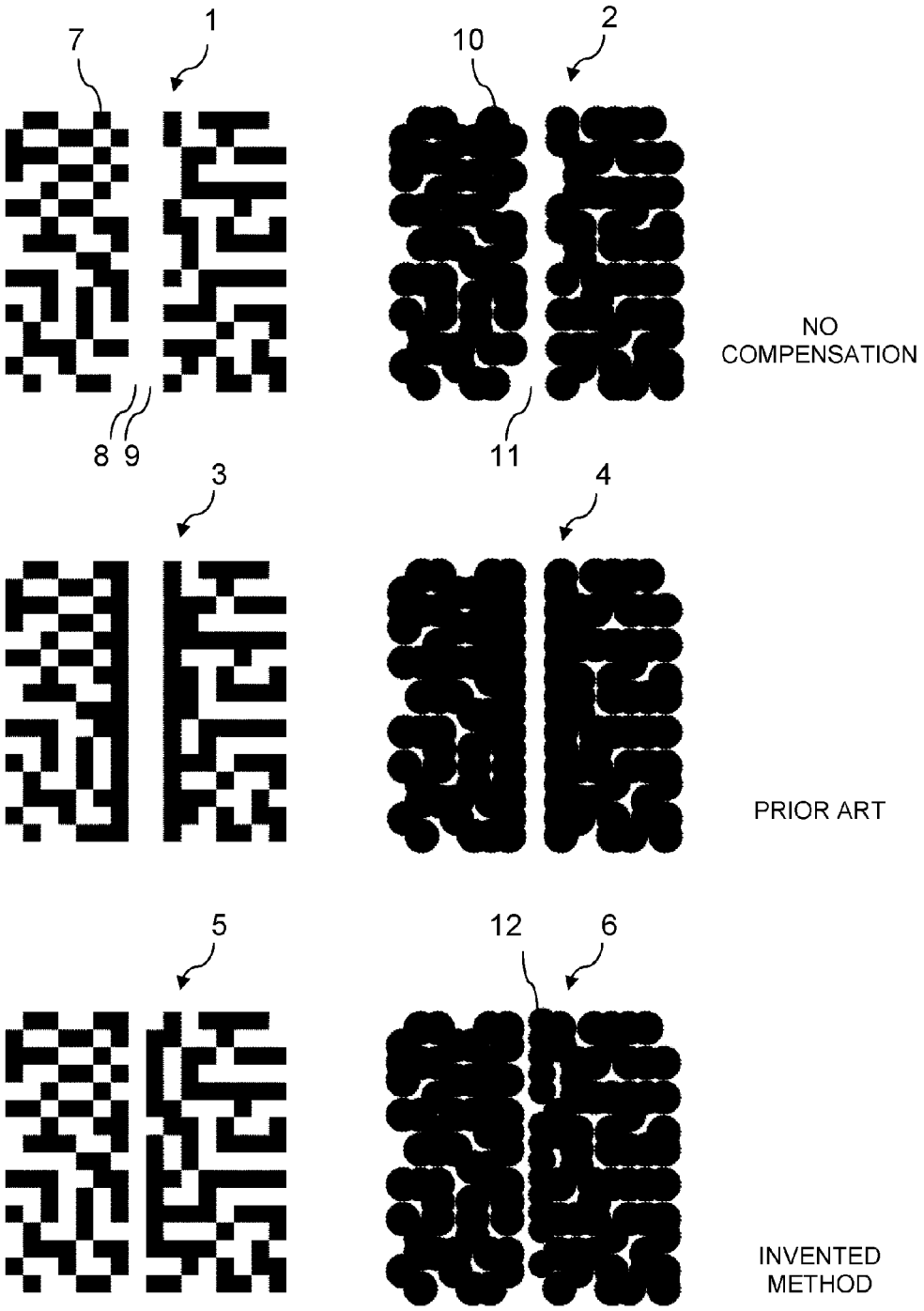
FIG. 2 shows a number of binary patterns related to failing nozzles in a row of nozzles.

FIG. 2 shows a number of binary patterns related to control signals for a printhead comprising 16 nozzles. In this pattern, 16 (horizontal) image lines are applied to a printhead, moving in a (vertical) direction relative to a receiving medium. Patterns 1 and 2 relate to a situation wherein no compensation for failing nozzles has been applied. In pattern 1, a white square indicates a control signal that does not lead to the application of an ink drop of a corresponding printhead element, whereas a black quare, such as element 7, indicates a control signal that leads to the application of an ink drop. The absence of black squares in columns 8 and 9 is a result of nozzles 8 and 9 in the row being labeled as failing. Even though an image to be printed may contain halftone dots for positions in these columns, no ink jet element will be activated and no substituting element is involved. Pattern 2 is a simulated dot pattern related to the control signals of pattern 1. A dot, such as 10, overlaps other dots, since the dot size exceeds the pixel size. The white line 11, or a line lacking colorant, will be visible in the printed image on this position, since the dot size is not sufficient to cover a gap of two missing nozzles.

Pattern 3 and 4 in FIG. 2 comprise similar patterns, but in this case a compensation scheme for failing nozzles is used according to the prior art. The dots related to a failing nozzle are distributed to a neighboring nozzle, in this case nozzle 7 and 10. In pattern 3, this is visible as completely filled columns adjacent to the columns for the failing nozzles. Although a missing optical density is somewhat compensated, a white line is still visible in pattern 4, which is a simulated ink dot pattern corresponding to the control signal pattern 3.

In pattern 5 and 6 in FIG. 2 the effect of the invented method is shown. Nozzle 8 is assumed to be blocked, whereas nozzle 9 applies an ink drop that has a volume that is 30% below the nominal volume, leading to a dot that has a diameter that is 20% below the dot size of a functioning nozzle and the drop velocity is smaller than usual, leading to a shift of the dot position of 60% of the nominal dot diameter. Nozzle 9 is therefore a deviating nozzle, that is not controlled to be applied if its neighboring nozzles are functioning. However, in the shown patterns, a neighboring nozzle, nozzle 8, of nozzle 9 is failing, since it is blocked. Therefore, the control signal pertaining to nozzle 9 is not distributed to a neighboring nozzle, but is applied by nozzle 9. Pattern 6 shows that in the simulated dot pattern, the white line is less visible than before, although the dots, such as dot 12, are smaller than other dots and slightly shifted upwards. Note that, since nozzle 8 is blocked, the control signal pertaining to nozzle 8 is distributed to its neighboring nozzles, among which nozzle 9, thereby providing compensation for nozzle 8.

Figure 3:
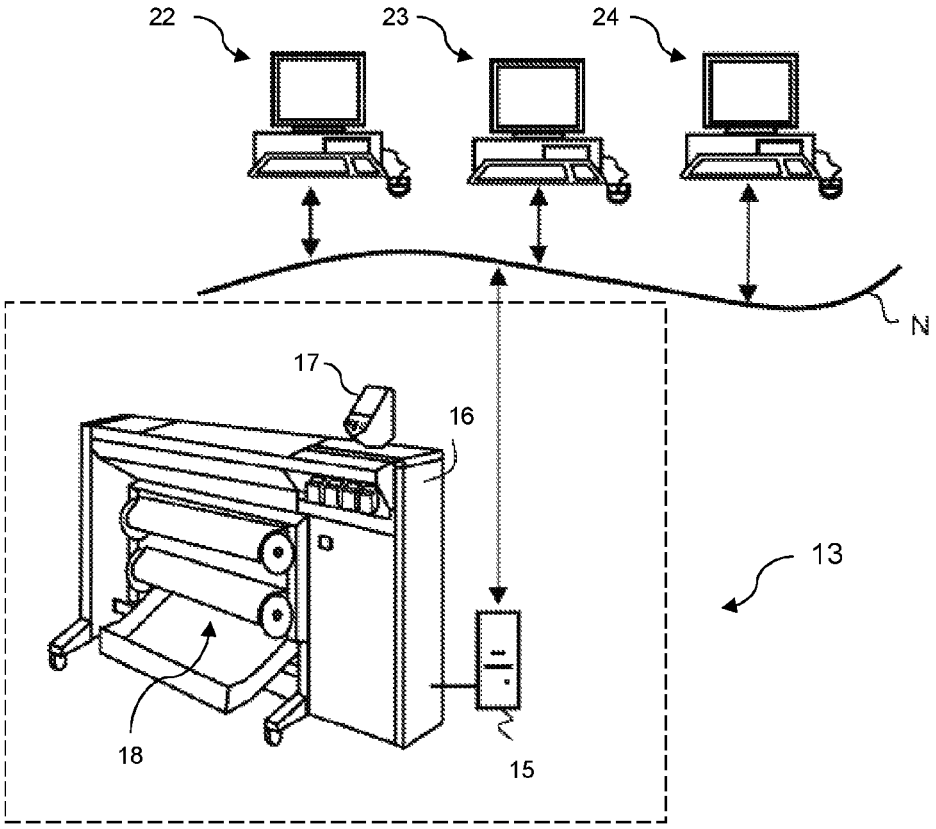
FIG. 3 is an inkjet print system wherein the invented method is applicable.

FIG. 3 shows an inkjet print system 13, connected to a network N, which is in further connection with work stations 22, 23 and 24. The print system comprises a controller 15 for receiving print jobs through the network and converting them to printable images. The print system further comprises an embedded controller 16 for controlling the functions of the printer, although, alternatively, the image processing functionality of the external controller 15 and the embedded controller 16 may be combined. The printer also comprises a user interface 17 for instructing the print system and, in this particular embodiment, media rolls 18 for supplying a receiving medium for the printing images. The printhead (not shown) comprises a row of nozzles perpendicular to the direction wherein the printhead reciprocates, whereas the row of nozzles is parallel to a transport direction of the receiving medium. The print system comprises a detection unit for detecting a status of a nozzle and a control unit labels each nozzle as functioning, deviating or blocked, according to a detected position of a dot associated with the nozzle. At the time of processing an image into control signals for the print head, the invented method is applied by the control unit.

The invention being thus described, it will be obvious that the same may be varied in many ways. Such variations are not to be regarded as a departure from the invention, and all such modifications as would be obvious to one skilled in the art are intended to be included within the scope of the following claims.

What is claimed:

1. A method for controlling the ejection of ink drops from an inkjet printhead comprising an array of ink chambers with nozzles arranged for applying a row of ink dots on a receiving medium using a control signal, the method comprising the steps of:

a) labeling a nozzle as a functioning nozzle if the nozzle, upon activation by a control signal, ejects an ink drop within predefined specifications, otherwise labeling the nozzle as a failing nozzle, and b) distributing a control signal associated with a failing nozzle to a neighboring nozzle to maintain a local optical density, wherein said control signal associated with a failing nozzle is not distributed to a neighboring nozzle, but directed as if the nozzle were not failing, if at least one of the neighboring nozzles of said failing nozzle is also labeled as a failing nozzle.

2. The method according to claim 1, wherein a failing nozzle is labeled as either a blocked nozzle, if no ink drop is ejected upon activation by a control signal, or a deviating nozzle, if an ink drop outside predefined specifications is ejected, and a control signal associated with a deviating nozzle is not distributed to a neighboring nozzle, if at least one of the neighboring nozzles of said deviating nozzle is labeled as a failing nozzle, but a control signal associated with a blocked nozzle is distributed to a neighboring nozzle, if at least one of the neighboring nozzles of said blocked nozzle is labeled as a failing nozzle.

3. The method according to claim 1, wherein the step of labeling a nozzle is made during an application of the inkjet printhead in a print process.

4. The method according to claim 3, wherein the step of labeling a nozzle is made using a feedback signal from a sensor element associated with the nozzle in the printhead.

5. The method according to claim 4, wherein the sensor element for giving a feedback signal is also used as an actuator element for ejecting ink from the ink nozzle.

6. The method according to claim 3, wherein the step of labeling a nozzle is made using an optical sensor to monitor a pattern printed by the printhead.

7. An inkjet print system for printing images on a receiving medium by controlling a printhead to eject ink, the inkjet print system comprising a control unit that is configured to execute the steps of the method according to claim 1.

* * * * *